US008500055B2

(12) United States Patent
Saheta et al.

(10) Patent No.: US 8,500,055 B2
(45) Date of Patent: Aug. 6, 2013

(54) COIL TUBING SYSTEM

(75) Inventors: Vishal Saheta, Houston, TX (US); Rod Shampine, Houston, TX (US); Jason Turk, Katy, TX (US); Don Cardon, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 89 days.

(21) Appl. No.: 11/362,410

(22) Filed: Feb. 23, 2006

(65) Prior Publication Data

US 2007/0194164 A1 Aug. 23, 2007

(51) Int. Cl.
*B65H 75/44* (2006.01)

(52) U.S. Cl.
USPC ..... 242/407; 242/613; 166/77.2

(58) Field of Classification Search
USPC .. 242/388, 402, 407, 579, 598, 613; 166/384, 166/77.2
See application file for complete search history.

(56) References Cited

U.S. PATENT DOCUMENTS

| | | | | |
|---|---|---|---|---|
| 1,612,206 | A * | 12/1926 | Nicholson | 137/355.19 |
| 2,642,312 | A * | 6/1953 | Shine | 137/355.2 |
| 2,783,089 | A * | 2/1957 | Prout | 137/355.17 |
| 3,702,223 | A * | 11/1972 | Bednar | 417/375 |
| 4,441,561 | A * | 4/1984 | Garmong | 166/387 |
| 4,795,108 | A | 1/1989 | Appling | |
| 5,090,039 | A | 2/1992 | Gard et al. | |
| 5,183,218 | A | 2/1993 | Gavagna | |
| 5,865,392 | A | 2/1999 | Blount et al. | |
| 6,352,216 | B1 | 3/2002 | Coats | |
| 6,435,447 | B1 | 8/2002 | Coats et al. | |
| 6,460,796 | B1 | 10/2002 | Berning et al. | |
| 6,488,088 | B1 * | 12/2002 | Kohli et al. | 166/285 |
| 6,497,290 | B1 * | 12/2002 | Misselbrook et al. | 166/384 |
| 6,712,150 | B1 * | 3/2004 | Misselbrook et al. | 166/384 |

FOREIGN PATENT DOCUMENTS

| | | |
|---|---|---|
| WO | WO 0035790 | 6/2000 |
| WO | WO 0163084 | 8/2001 |

OTHER PUBLICATIONS

Definition of tubing from Merriam-Webster's Dictionary Online, 11th Edition (http://www.merriam-webster.com/dictionary/tubing).*

* cited by examiner

*Primary Examiner* — William E Dondero
(74) *Attorney, Agent, or Firm* — Michael Flynn; Robin Nava; Tim Currington

(57) ABSTRACT

A coil tubing system including a reel having a core rotatable about a horizontal axis, the core having a surface defining an interior cavity about the horizontal axis and a tubing having an inlet end positioned proximate the horizontal axis. A bend is formed in the tubing between the inlet end and a core point of the tubing positioned proximate the core surface, the permanent bend positioned substantially within the interior cavity.

11 Claims, 2 Drawing Sheets

COIL TUBING SYSTEM

FIELD OF THE INVENTION

The present invention relates in general to coiled tubing systems and more specifically to a coil tubing system that facilitates inspection of the coil tubing.

BACKGROUND

Coil tubing systems are well known and commonly used in many fields including wellbore and pipe laying operations. Common to these systems is a reel having a core onto which the tubing is spooled. Typically the inlet end of the tubing is positioned on the circumference of the core such that the tubing has a bend radius close to that of the drum radius. Treating iron plumbing then utilizes bends to connect to the inlet end. These systems have drawbacks that heretofore have not been adequately addressed. For example, the current systems do not provide access to the inlet section or the bed wrap portion of the tubing without spooling the tubing from the reel.

Therefore, it is a desire to provide a coil tubing system that addresses drawbacks of current and prior art coil tubing systems. It is a desire to provide a coil tubing system that facilitates access to the inlet section of the tubing for inspection. It is a still further desire to provide a coil tubing system that facilitates access to the bed wrap of the tubing for inspection.

SUMMARY OF THE INVENTION

An embodiment of a coil tubing system includes a reel having a core rotatable about a horizontal axis, the core having a surface defining an interior cavity and a tubing having an inlet end and an inlet section, wherein the inlet end and inlet section are positioned substantially in the interior cavity. The inlet end may be connected to a treating iron proximate the horizontal axis of the reel. The treating iron may be substantially straight. The inlet section may extend from the inlet end to a core point, wherein the core point is positioned proximate the core surface. One or more windows may be formed through the core surface.

The inlet section may include a bend or curve. The curve or bend may be a substantially permanent bend formed in the tubing between approximately the inlet end and the core point. The inlet end and the core point may be offset from each other relative to a plane extending perpendicular to the horizontal axis of the reel. The inlet end and the core point may be substantially aligned in a plane extending substantially perpendicular to the horizontal axis of the reel.

In another embodiment, the coil tubing system includes a reel having a core rotatable about a horizontal axis, the core having a surface defining an interior cavity about the horizontal axis, a tubing having an inlet end positioned proximate the horizontal axis, a permanent bend formed in the tubing between the inlet end and a core point of the tubing positioned proximate the core surface, the permanent bend positioned substantially within the interior cavity, and a window formed through the core surface.

An embodiment of a method for accessing a portion of a tubing spooled on a reel includes the steps of providing a reel having a core rotatable about a horizontal axis, the core having a surface defining an interior cavity about the horizontal axis; forming a permanent bend in an inlet section of the tubing proximate an inlet end of the tubing; positioning the inlet end and the inlet section substantially within the interior cavity; and spooling a length of the tubing beyond the inlet section on the core. The method may further include the step of forming an opening through the core surface. The method may further comprise the step of inspecting the tubing through the interior cavity. The inspection may include any suitable method of inspection including, but not limited to, visual and ultrasonic inspection.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
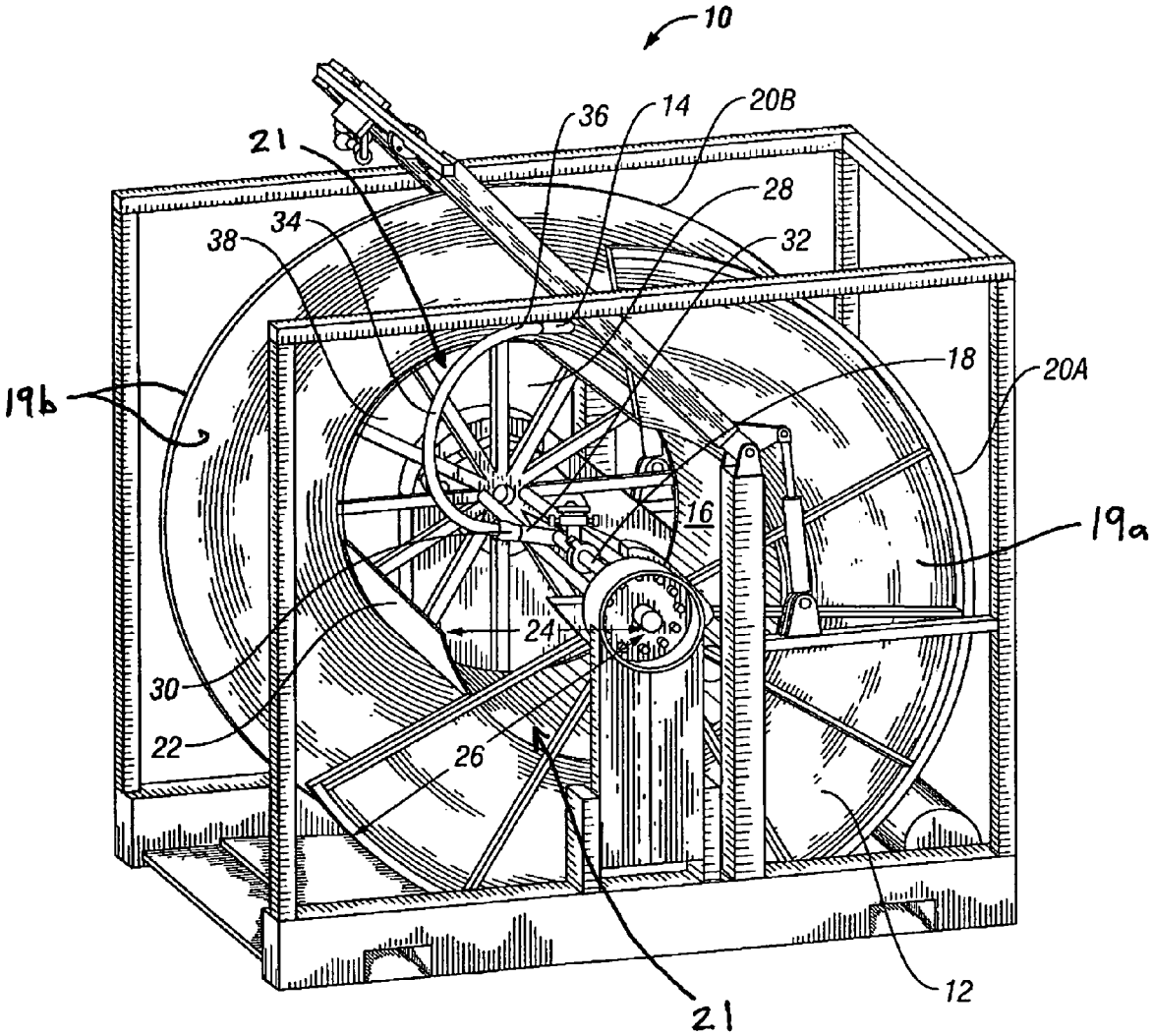
FIG. 1 is a partial cross-sectional view of an embodiment of the coil tubing system of the present invention wherein the tubing has an out-of-plane internal bend.

Refer now to the drawings wherein depicted elements are not necessarily shown to scale and wherein like or similar elements are designated by the same reference numeral through the several views.

FIG. 1 is a partial cross-section view of an embodiment of the coiled tubing system of the present invention, generally denoted by the numeral 10. Coiled tubing system 10 includes a reel 12 and coiled tubing 14. As is well known in the art, tubing 14 is spooled onto reel 12 for storage and transport to a location in which tubing 14 is to be utilized. For example, coil tubing system 10 may be transported to a wellsite for injecting the coil tubing into a wellbore to perform fracturing operations.

Reel 12 includes a core 16 and flanges 20*a* and 20*b*. The flanges 20*a* and 20*b* define respective interior and exterior surfaces 19*a* and 19*b*. Reel 12 is rotatable about a horizontal axis 18. Core 16 is a cylindrical member having a surface 22 that is positioned a distance 24 from horizontal axis 18 and defines the core radius of reel 12. The outer surface of flanges 20 extend a distance 26 defining the flange radius of reel 12. Cylindrical core 16 further defines an interior cavity 28. The interior cavity 28 of the core 16 is accessible through respective openings 21 formed in the surfaces 19*a* and 19*b* of the flanges 20*a* and 20*b*.

Tubing 14 has an inlet end 30 adapted to connect to treating iron 32. Tubing 14 includes an inlet section 34 extending substantially from inlet end 30 to a core point 36. In an embodiment of the present invention, treating iron 32 is positioned proximate horizontal rotational axis 18 of reel 12. At this location, treating iron 32 may be a substantially straight member thus reducing restrictions in the flow path to tubing 14.

Inlet section 34 of tubing 14 includes permanent bend, or curve, such that when inlet end 30 is connected to treating iron 32, core point 36 is positioned proximate core bed 22 for spooling the length of tubing 14 thereon. Inlet section 34 containing the permanent bend is positioned substantially within interior cavity 28.

Figure 2:
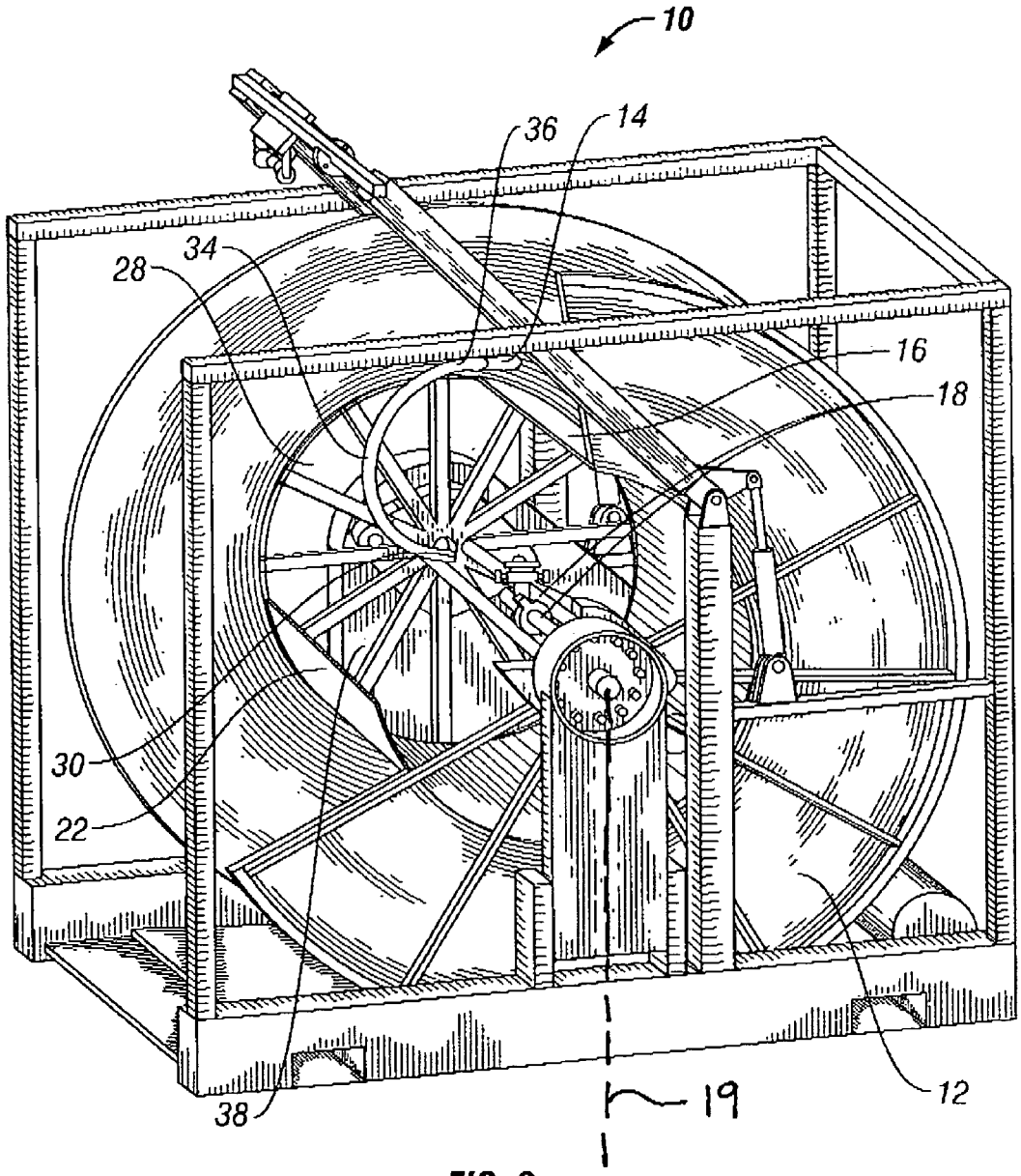
FIG. 2 is a partial cross-sectional view of an embodiment of the coil tubing system of the present invention wherein the tubing has an in-plane internal bend.

In the embodiment illustrated in FIG. 1, inlet end 30 and core point 36 are offset from each other relative to a plane 19 (best seen in FIG. 2) extending perpendicular from horizontal rotational axis 18, such that the inlet end 30 and the core point 36 are disposed at respective points that are a different distance along the axis 18 between the flanges 20A and 20B. This configuration is referred to as an out-of-plane internal bend. FIG. 2 illustrates an in-plane internal bend, wherein inlet end 30 and core point 36 are substantially aligned within a plane extending substantially perpendicular to horizontal axis 18 such that the inlet end 30 and the core point 36 are disposed at respective points that are the same distance along the axis 18 between the flanges 20A and 20B. Various curve configurations of inlet section 34 may be utilized.

As shown in FIGS. 1 and 2, core 16 may further include one or more windows 38 formed through the surface 22 of the core 16. Windows 38 provide access to tubing 14 to inspect the bed wrap of tubing 14. Various methods, including ultrasonic testing, may be utilized to inspect tubing 14 via interior cavity 28 and windows 38.

Coiled tubing system 10 of the present invention provides several benefits relative to the prior and current coiled tubing systems. In the current and prior art systems, the tubing inlet is positioned at the circumference or surface of the core and the treating iron incorporates bends to reach the tubing inlet. Further, the inlet section, which is subject to the greatest wear in many applications, is positioned on the core surface within the bed wrap. Thus, it is very difficult to inspect the inlet section to avoid costly and dangerous failures.

Coil tubing system 10 of the present invention positions inlet section 34 within interior cavity 28 providing ready access for inspecting inlet section 34. Further, the present invention provides access to the bed wrap of tubing 14 for inspection. Still further, system 10 facilitates the utilization of substantially straight treating iron 32. Thus, flow path restrictions are reduced in the present invention. Still further, the present invention facilitates external ball drop through tubing 14, pigging of tubing 14 and the pumping of cable through tubing 14.

From the foregoing detailed description of specific embodiments of the invention, it should be apparent that a coiled tubing system that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A coil tubing system, the system comprising:

a reel having a core rotatable about a horizontal axis and a flange extending perpendicularly from each end of the core, the core having a surface defining an interior cavity, the flange has an opening for accessing the interior cavity, the core surface defining at least one opening therein, the opening on the core surface extending along the entire width of the core surface between each flange on the end of the core;

a metallic oilfield coiled tubing having an inlet end and an inlet section, wherein the inlet end and inlet section are positioned substantially in the interior cavity, the inlet section extending from the inlet end to a core point located proximate the surface of the core in a form of a substantially arcuate curve, wherein the inlet end and the core point are offset from each other such that the inlet end and the core point are at different distances along the axis between the flanges, the coiled tubing disposed on the core surface when wrapped thereabout, the opening in the core surface providing access to inspect a bed wrap of the coiled tubing from the interior cavity; and a treating iron positioned proximate the horizontal axis of the reel and connected to the inlet end of the metallic oilfield coiled tubing.

2. The system of claim 1, wherein the curve is a permanent bend in the tubing.

3. The system of claim 1, wherein the opening and the flange openings provide ready access for inspecting the inlet end from the interior cavity.

4. The system of claim 1, wherein the system is transportable to a wellsite for injecting the coiled tubing into a wellbore.

5. A coil tubing system, the system comprising:

a reel having a core rotatable about a horizontal axis and a flange extending perpendicularly from each end of the core, the core having a surface defining an interior cavity about the horizontal axis, the flange has an opening for accessing the interior cavity and the core surface having at least one window formed therethrough the window on the core surface extending along the entire width of the core surface between each flange on the end of the core;

a metallic oilfield coiled tubing having an inlet end positioned proximate the horizontal axis, a bed wrap of the coiled tubing disposed on the core surface when wrapped thereabout and the opening providing access to inspect the bed wrap of the coliled tubing from the interior cavity;

a permanent bend formed in the coiled tubing between the inlet end and a core point of the tubing positioned proximate the core surface, the permanent bend positioned substantially within the interior cavity and being shaped in a substantially arcuate curve, wherein the inlet end and the core point are offset from each other such that the inlet end and the core point are at substantially the same distance along the axis between the flanges, wherein the window and the flange openings provides ready access for inspecting the inlet end and from the interior cavity; and a treating iron positioned proximate the horizontal axis of the reel and connected to the inlet end of the metallic oilfield coiled tubing.

6. The system of claim 5, wherein the system is transportable to a wellsite for injecting the coiled tubing into a wellbore.

7. A method for accessing a portion of a metallic oilfield coiled tubing spooled on a reel, the method comprising the steps of:

providing a reel having a core rotatable about a horizontal axis and a flange extending perpendicularly from each end of the core, the core having a surface defining an interior cavity about the horizontal axis and having at least one opening formed therethrough the opening on the core surface extending along the entire width of the core surface between each flange on the end of the core, the flange has an opening for accessing the interior cavity;

forming a permanent bend in an inlet section of the coiled tubing proximate an inlet end of the coiled tubing, said permanent bend being shaped in a substantially arcuate curve;

positioning the inlet end and the inlet section substantially within the interior cavity, wherein the inlet section extends to a core point;

connecting the inlet end to a treating iron positioned proximate to the horizontal axis of the reel;

spooling a length of the metallic oilfield coiled tubing beyond the inlet section on the core, a bed wrap of the coiled tubing disposed on the core surface when spooled thereabout; and inspecting the metallic oilfield coiled tubing from within the interior cavity, wherein inspecting comprises inspecting the tubing through the openings in the core surface and the flange surfaces from the interior cavity.

8. The method of claim 7 further comprising injecting the coiled tubing in to the wellbore and performing a wellsite operation.

9. The method of claim 8 wherein performing comprises performing a fracturing operation.

10. The method of claim 8 wherein positioning comprises positioning the inlet end and the core point offset from each other such that the inlet end and the core point are at different distances along the axis between the flanges.

11. The method of claim 8 wherein positioning comprises aligning the inlet end and the core point such that the inlet end and the core point are substantially aligned with each other such that the inlet end and the core point are at substantially the same distance along the axis between the flanges.

* * * * *